US006009556A

United States Patent [19]

Nenninger

[11] Patent Number: 6,009,556

[45] Date of Patent: Jan. 4, 2000

[54] BATHING SUIT OF CHANGEABLE APPEARANCE FOR FEMALES

[76] Inventor: Nanci I. Nenninger, 5557 S. Gainsborough Rd., Tucson, Ariz. 85746

[21] Appl. No.: 09/209,835

[22] Filed: Dec. 11, 1998

[51] Int. Cl.[7] ..... A41D 5/00; A41F 19/00; A41F 3/00; A41F 3/02; A41C 3/08

[52] U.S. Cl. ..... 2/67; 2/338; 2/301; 2/326; 450/30

[58] Field of Search ..... 2/67, 109, 110, 2/336, 338, 300, 301, 326; 450/7, 11, 30

[56] References Cited

U.S. PATENT DOCUMENTS

| | | | |
|---|---|---|---|
| 2,042,924 | 6/1936 | Cunningham . | |
| 2,402,835 | 6/1946 | Nagy . | |
| 2,803,823 | 8/1957 | Broadwin . | |
| 3,740,765 | 6/1973 | Delplace | 2/67 |
| 3,982,547 | 9/1976 | Walker | 450/28 |
| 4,004,297 | 1/1977 | Polack | 2/227 |
| 4,301,545 | 11/1981 | Camarena | 2/67 |
| 4,306,317 | 12/1981 | Joseph | 2/67 |
| 4,635,640 | 1/1987 | Sehorn | 450/14 |
| 4,656,669 | 4/1987 | Beard | 2/67 |
| 4,815,145 | 3/1989 | Chow | 2/67 |
| 5,083,316 | 1/1992 | Kuehner | 2/67 |
| 5,162,015 | 11/1992 | Otani | 450/7 |

*Primary Examiner*—John J. Calvert
*Assistant Examiner*—Shirra L. Jenkins
*Attorney, Agent, or Firm*—Antonio R. Durando

[57] ABSTRACT

A bathing suit of the bikini type for females comprises two discrete tops and a bottom. Each of the bikini tops includes a cup, a section of a neck strap and a section of a back strap. The neck strap sections can be releasably connected to one another as can the back strap sections. Each of the bikini tops further includes an additional strap which is provided with a coupling element and is designed to extend to the bikini bottom. Several coupling elements are located on the inside of the bikini bottom and can be connected to the coupling element on either of the additional straps. The appearance of the bathing suit can be changed by attaching the additional straps to various ones of the coupling elements on the bikini bottom. An extension is provided for the neck strap and makes further changes in appearance possible. Thus, while the neck strap itself is too short to be crossed, the extension enables crossing to be achieved.

17 Claims, 10 Drawing Sheets

BATHING SUIT OF CHANGEABLE APPEARANCE FOR FEMALES

BACKGROUND OF THE INVENTION

1. Field of the Invention

The invention relates to apparel for females.

2. Description of the Prior Art

Many females possess several versions of any given type of apparel since they prefer not to be seen in clothing of the same appearance too often. Inasmuch as it can be expensive to own several versions of each of the many different types of apparel, convertible apparel has been developed. Such apparel generally consists of a number of different items including one or more which are removable or interchangeable. However, the convertible apparel currently available is somewhat cumbersome to convert.

SUMMARY OF THE INVENTION

It is an object of the invention to simplify the conversion of apparel from one appearance to another.

The preceding object, as well as others which will become apparent as the description proceeds are achieved by the invention.

One aspect of the invention resides in female apparel. The apparel comprises a first cup, a second cup, and at least one strap for supporting the cups.

According to one embodiment of the invention, the apparel further comprises a first additional strap designed to extend downward from the first cup when the first cup is being worn, and a second additional strap designed to extend downward from the second cup when the second cup is being worn. The additional straps are relatively movable between a position in which the additional straps cross and a position in which the additional straps are uncrossed. This embodiment of the apparel also comprises a covering for the crotch, and a plurality of first coupling elements on the covering. Each of the additional straps includes a second coupling element releasably connectible to each of the first coupling elements.

Since the additional straps in the apparel of the invention are movable relative to one another, the appearance of the apparel may be easily altered by changing the relative position of the additional straps. Moreover, the cooperating coupling elements on the crotch covering and the additional straps allow the latter to be fixed in different relative positions in a simple manner.

In accordance with another embodiment of the invention, the supporting strap of the apparel includes a first section connected to the first cup, a second section connected to the second cup, and first means for releasably connecting the first and second sections to one another. Here, the apparel additionally comprises an extension which is insertable between the first and second sections and includes second means for releasably connecting the extension to the first connecting means.

The added length provided by the extension makes it possible to easily alter the appearance of the apparel by repositioning, e.g., rerouting, the supporting strap.

Another aspect of the invention resides in a method of altering the appearance of female apparel.

One embodiment of the method is directed to apparel having a first cup, a second cup, a covering for the crotch, a first strap extending from the first cup to a first location of the covering and a second strap extending from the second cup to a second location of the covering. This embodiment of the method comprises the step of shifting at least part of the first strap so that the first strap extends from the first cup to a location of the covering different from the first location.

The present embodiment of the method can further comprise the step of shifting at least part of the second strap so that the second strap extends from the second cup to a location of the crotch covering different from the second location.

The first and second straps may be uncrossed before the first strap is shifted and the step of shifting the first strap can then comprise crossing the straps. It is likewise possible for the straps to be crossed prior to shifting of the first strap and, in such an event, the step of shifting the first strap may involve uncrossing the straps.

The apparel can include another strap for supporting the cups. The instant embodiment of the method can here comprise the steps of arranging the supporting strap so that it is uncrossed, and repositioning the supporting strap such that portions thereof cross. Alternatively, the instant embodiment can involve arranging the supporting strap so that portions of the supporting strap cross, and subsequently repositioning the supporting strap so that it is uncrossed.

Another embodiment of the method of the invention is drawn to female apparel having a first cup, a second cup, and at least one strap which serves to support the cups and has two separable sections. This embodiment comprises the step of inserting an extension between the sections. The present embodiment can further comprise the step of varying the effective length of the extension.

Additional features and advantages of the invention will be forthcoming from the following detailed description of preferred embodiments when read in conjunction with the accompanying drawings.

DESCRIPTION OF THE PREFERRED EMBODIMENTS

Figure 1:
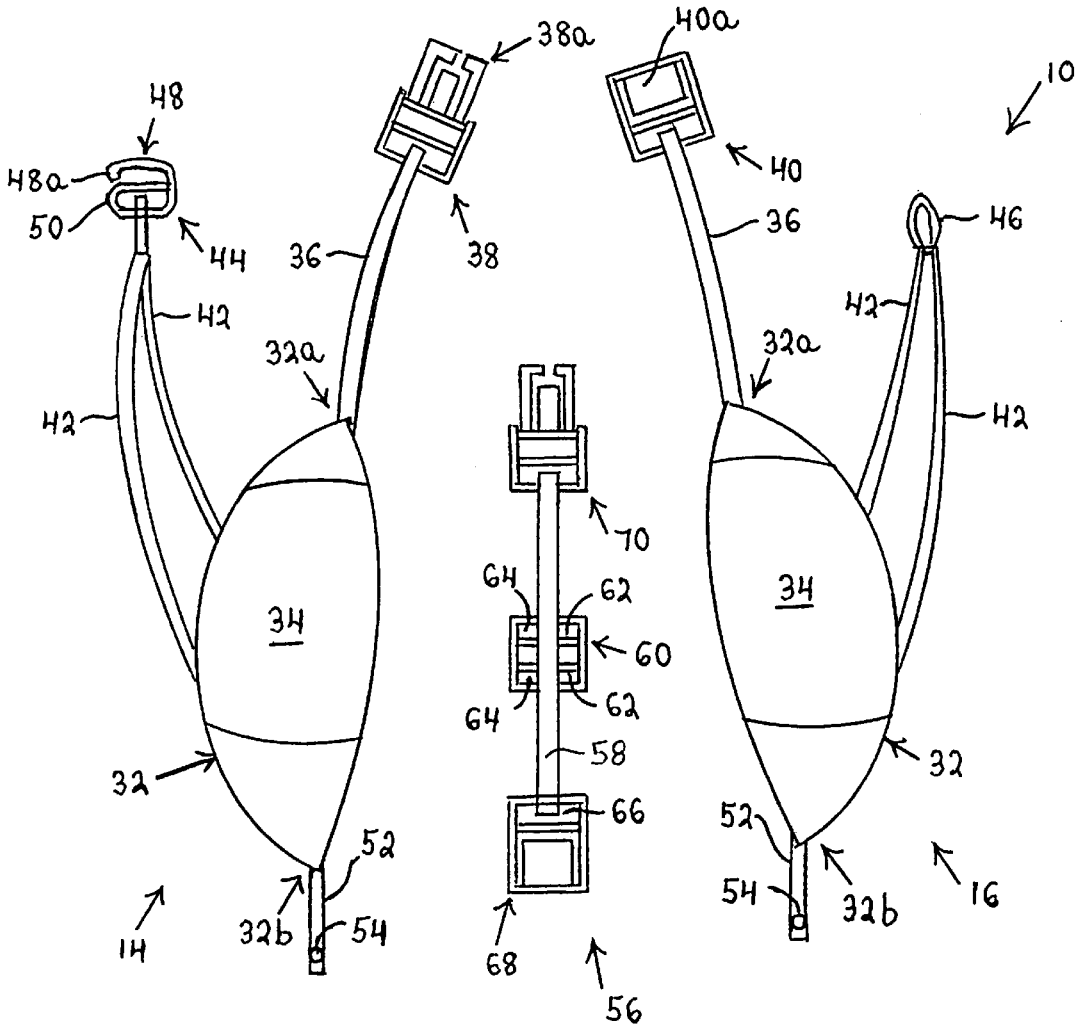
FIG. 1 is a plan view of female apparel according to the invention.
Figure 1:
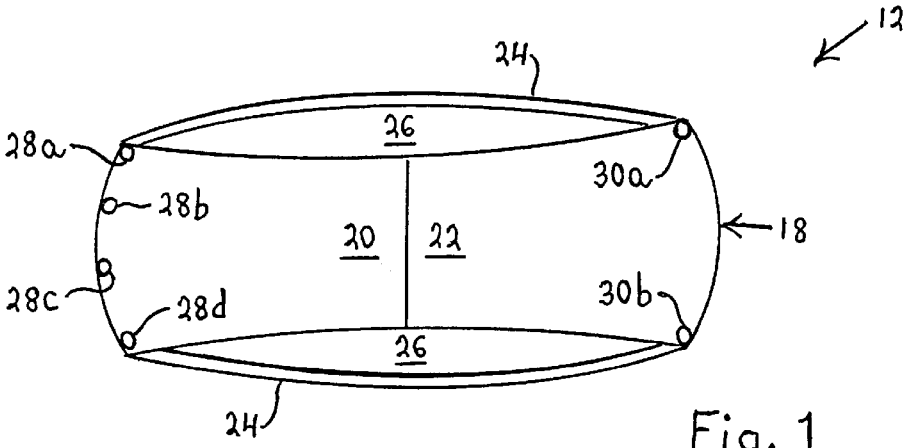

Referring to FIG. 1, the numeral 10 identifies apparel or clothing which is made in accordance with the invention and is designed to be worn by females. The apparel 10 is here a bathing suit of the bikini type.

The bathing suit 10 comprises a discrete article of clothing 12, a discrete article of clothing 14 and a discrete article of clothing 16. The article 12 is a bikini bottom or panty and functions as a covering for the lowermost part of the torso which includes the crotch. The articles 14 and 16, on the other hand, are bikini tops which serve as coverings for respective upper parts of the torso including at least portions of the breasts.

FIG. 1 shows the inside of the bikini bottom 12, that is, the side of the bikini bottom 12 which faces the body.

The bikini bottom 12 comprises a conventional contoured fabric element 18 having an elastic periphery. The fabric element 18, which passes between the legs, has a front portion 20 which extends upward over the genital region and a back portion 22 which extends upward over the anal region. The front portion 20 may consist of two layers of fabric as is conventional.

The bikini bottom 12 further comprises two elastic straps or strings 24 which are located on opposite sides of the fabric element 18. The straps 24 run longitudinally of the fabric element 18, and one end of each strap 24 is attached to the front end of the element 18 while the opposite end of each strap 24 is attached to the rear end of the element 18. The straps 24 cooperate with the fabric element 18 to define two openings 26 through which the legs are passed.

Four coupling elements or fastening elements 28*a*, 28*b*, 28*c* and 28*d* are secured to the fabric element 18 at the front edge thereof. The coupling elements 28*a*–28*d* are spaced from one another circumferentially of the fabric element 18. Two additional coupling or fastening elements 30*a* and 30*b*, which are again spaced from each other circumferentially of the fabric element 18, are secured to the element 18 at the rear edge of the element 18. The coupling elements 28*a*–28*d* and 30*a*,30*b*, which are identical, are located on the inside of the bikini bottom 12.

The coupling element 28*a* will be referred to as the right outer coupling element; the coupling element 28*d* as the left outer coupling element; the coupling element 28*b* as the right inner coupling element; the coupling element 28*c* as the left inner coupling element; the coupling element 30*a* as the right rear coupling element; and the coupling element 30*b* as the left rear coupling element. These designations represent the positions of the coupling elements 28*a*–28*d* and 30*a*,30*b* on a wearer of the bathing suit 10.

As is the case for the bikini bottom 12, FIG. 1 shows the insides of the bikini tops 14,16. Since, with two exceptions, the bikini tops 14,16 are identical, only the bikini top 14 will be described in detail with the bikini top 16 being described as necessary to outline the differences between the bikini tops 14,16. Identical parts of the bikini tops 14,16 will be assigned the same reference numerals.

The bikini top 14 includes a cup 32 for a breast, and the cup 32 is constituted by a contoured fabric element having an elastic periphery. In conventional fashion, the central portion 34 of the cup 32 may include two layers of fabric. The cup 32 is elongated and has opposite longitudinal ends 32*a* and 32*b*. When the bikini top 14 is being worn, the longitudinal end 32*a* faces the head and the longitudinal end 32*b* faces the legs. Accordingly, the longitudinal end 32*a* will be referred to as the upper end of the cup 32 while the longitudinal end 32*b* will be referred to as the lower end of the cup 32.

The upper end 32*a* of the cup 32 is attached to one end of an elastic strap section or string section 36. The strap section 36 forms part of a neck strap or string which also includes the strap section 36 of the bikini top 16. The end of each strap section 36 remote from the respective cup 32 is formed with a loop, and a connecting element is anchored to each loop. The connecting element held by the loop on the strap section 36 of the bikini top 14 is the male portion 38 of a buckle while the connecting element held by the loop on the strap section 36 of the bikini top 16 is the female portion 40 of the buckle. The buckle 38,40 is conventional, and the male buckle portion 38 is provided with a tongue 38*a* which can slide into and be arrested by the female buckle portion 40. The female buckle portion 40 has a button 40*a* which can be depressed to release the tongue 38*a*.

The neck strap 36,38;36,40 is designed to pass around the neck of a wearer and support the cups 32.

The cup 32 of the bikini top 14 is further attached, along a longitudinal edge thereof, to one end of each of two elastic strap sections or string sections 42. The strap sections 42 are secured to spaced locations of the longitudinal edge, and such locations are disposed near the middle of the longitudinal edge to either side of the middle. The ends of the strap sections 42 remote from the cup 32 are joined to one another, and a loop is formed at the joint. A connecting element constituted by a clip 44 is anchored to the loop.

The strap sections 42 and clip 44 form part of a back strap or string which also includes the strap sections 42 of the bikini top 16. The loop at the juncture of the strap sections 42 of the bikini top 16 is identified by the numeral 46 and constitutes a connecting element which is designed to be releasably anchored to the clip 44. To this end, the clip 44 is provided with a leg 48 having a free end 48*a* which is normally in abutment, or almost in abutment, with a support section 50 of the clip 44. The support section 50 is held by the loop on the bikini top 14. The leg 48 is elastically hinged to the support section 50 so that the free end 48*a* can be pulled away therefrom to allow the loop 46 of the bikini top 16 to be slipped onto and off the leg 48.

The back strap 42,44;42,46 is designed to pass around the back of a wearer and support the cups 32.

The lower end 32*b* of the cup 32 of the bikini top 14 is attached to one end of an elastic strap 52. The end of the strap 52 remote from the cup 32 is provided with a coupling element 54 which can be releasably connected to any of the coupling elements 28*a*–28*d* and 30*a*,30*b* on the bikini bottom 12.

The bathing suit 10 additionally comprises an extension 56 for the neck strap 36,38;36,40. The extension 56 includes an elastic strap 58 having a loop at either end, and a conventional slide 60 in the form of a square or rectangular frame. A pair of spaced bars 62 bridges two opposite sides of the slide 60, and each of the bars 62 extends in parallelism with the two other sides of the slide 60. Each of these two other sides defines a slot-like opening 64 with a respective one of the bars 62. The strap 58 passes through a first one of the slot-like openings 64, over or under the bars 62, through the second slot-like opening 64, through an additional slot-like opening 66 in a connecting element 68 and back to the slide 60 where one end of the strap 58 is located. The loop at this end is anchored to one of the bars 62. The loop at the other end of the strap 58, on the other hand, is anchored to a connecting element 70. The connecting element 68 is here in the form of a female buckle portion while the connecting element 70 is in the form of a male buckle portion.

This conventional construction of the extension 56 allows the latter to be lengthened and shortened. The extension 56 can be lengthened by pulling the slide 60 and the male buckle portion 70 in opposite directions, and the extension 56 can be shortened by pulling the slide 60 and the female buckle portion 68 in opposite directions.

The female buckle portion 68 of the extension 56 is releasably connectible to the male buckle portion 38 of the bikini top 14 whereas the male buckle portion 70 of the extension 56 is releasably connectible to the female buckle portion 40 of the bikini top 16. The female buckle portion 68 and male buckle portion 70 can also be releasably connected to one another. The female buckle portion 68 of the extension 56 can be identical to the female buckle portion 40 of the bikini top 16 and, similarly, the male buckle portion 70 of the extension 56 can be identical to the male buckle portion 38 of the bikini top 14.

The operation of the bathing suit 10 will be described with reference to FIGS. 2–8 and 9*a*,9*b* which schematically illustrate different ways in which a female F may arrange the bathing suit 10. FIGS. 2–7 and 9*a* are front views of the female F while FIGS. 8 and 9*b* are back views.

Figure 2:
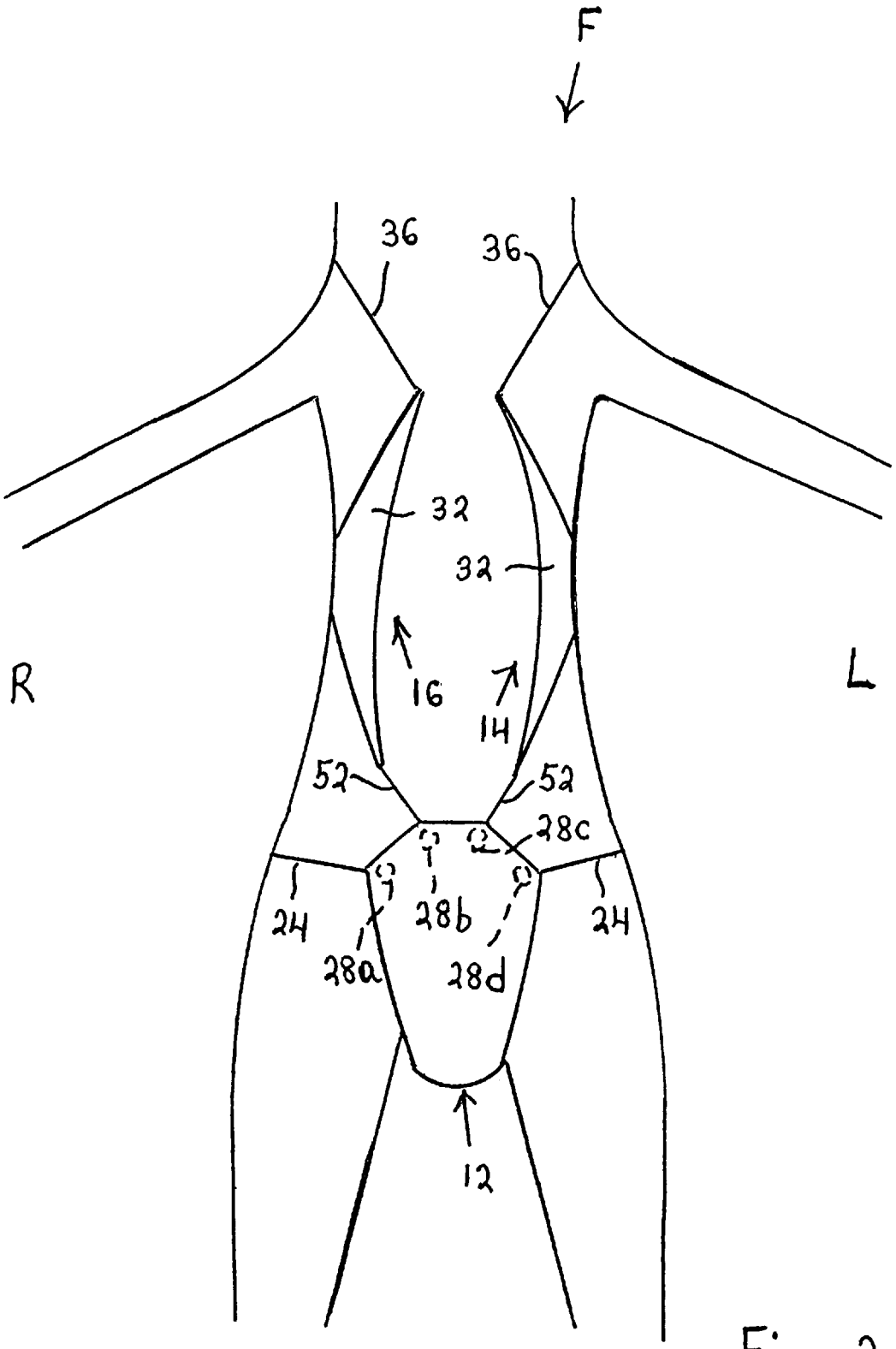
FIG. 2 is a schematic front view of a female wearing the apparel of FIG. 1 with one look.

In FIG. 2, the neck strap 36,38;36,40 is used without the extension 56. The neck strap section 36,38 of the bikini top 14 on the left side L of the female F passes over the left shoulder to the back of the neck and the neck strap section 36,40 of the bikini top 16 on the right side R of the female F passes over the right shoulder to the back of the neck. The male buckle portion 38 of the bikini top 14 is connected to the female buckle portion 40 of the bikini top 16 at the back of the neck. Furthermore, the coupling element 54 on the strap 52,54 of the bikini top 14 is connected to the left inner coupling element 28*c* on the bikini bottom 12 and the coupling element 54 on the strap 52,54 of the bikini top 16 is connected to the right inner coupling element 28*b* on the bikini bottom 12. Accordingly, the straps 52,54 converge in a direction from the bikini tops 14,16 to the bikini bottom 12 but do not intersect.

Figure 3:
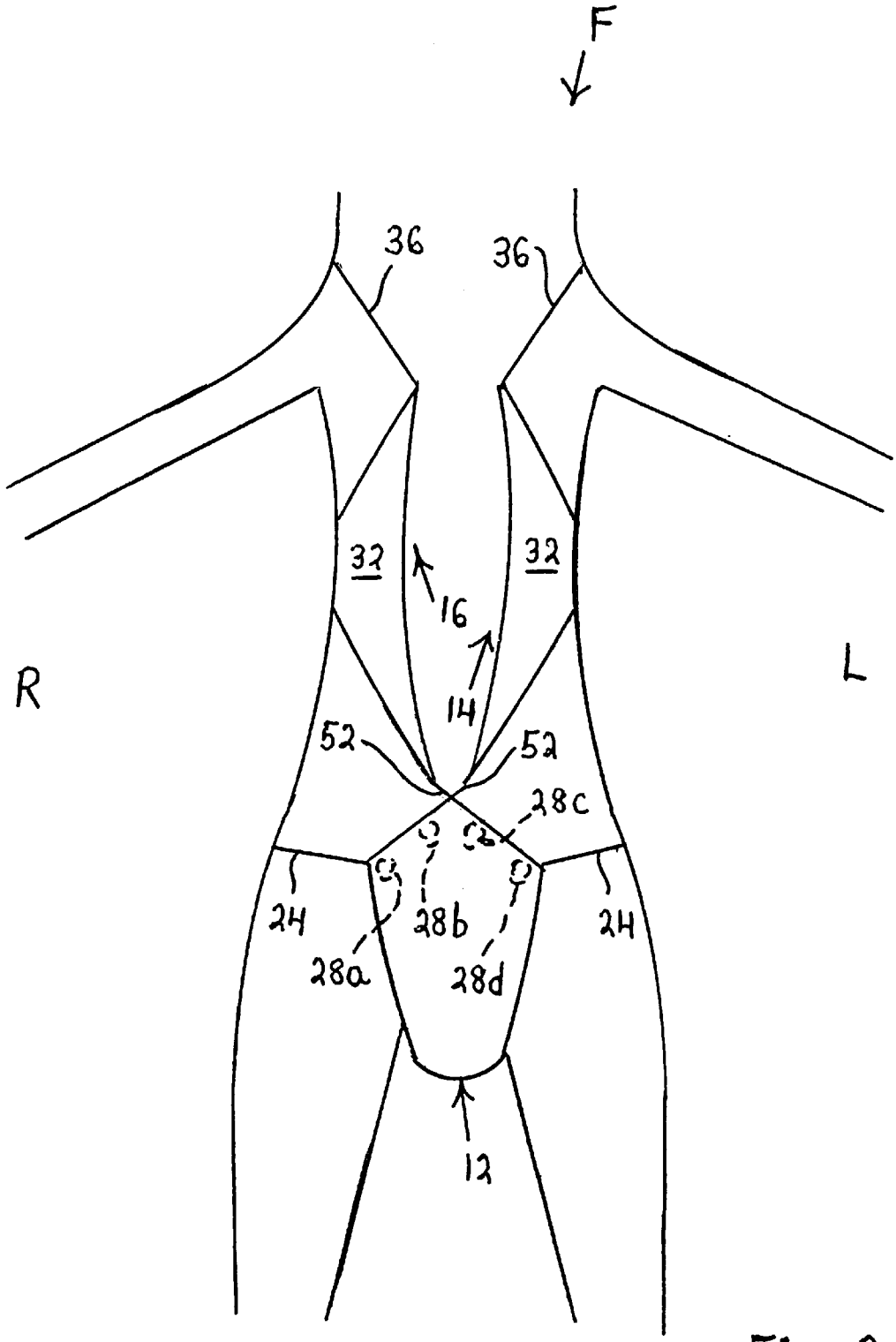
FIG. 3 is similar to FIG. 2 but shows another look of the apparel.

Referring to FIG. 3, the female F has rearranged the straps 52,54. This was accomplished by disconnecting the coupling elements 54 on the straps 52,54 from the inner coupling elements 28*b*,28*c* of the bikini bottom 12. The coupling element 54 on the strap 52,54 of the bikini top 14 was then connected to the right inner coupling element 28*b* on the bikini bottom 12 and the coupling element 54 on the strap 52,54 of the bikini top 16 was connected to the left inner coupling element 28*c* on the bikini bottom 12. As a result of this rearrangement, the straps 52,54 intersect at a location near the bikini bottom 12 leaving little or no skin visible between the intersection and the bikini bottom 12. Moreover, the lower portions of the cups 32 are drawn to the center of the torso and the top of the front portion 20 of the bikini bottom 12 assumes a peaked configuration.

Turning to FIG. 4, the female F has again rearranged the straps 52,54. The coupling element 54 on the strap 52,54 of the bikini top 14 has been disconnected from the right inner coupling element 28*b* on the bikini bottom 12 and connected to the right outer coupling element 28*a* on the bikini bottom 12. On the other hand, the coupling element 54 on the strap 52,54 of the bikini top 16 has been disconnected from the left inner coupling element 28*c* on the bikini bottom 12 and connected to the left outer coupling element 28*d* on the bikini bottom 12. Consequently, the straps 52,54 intersect farther away from the bikini bottom 12 than in FIG. 3 and a relatively large area of skin is observable between the intersection and the bikini bottom 12. The lower portions of the cups 32 remain drawn to the center of the torso while the top of the front portion 20 of the bikini bottom 12 now is slightly concave.

Figure 5:
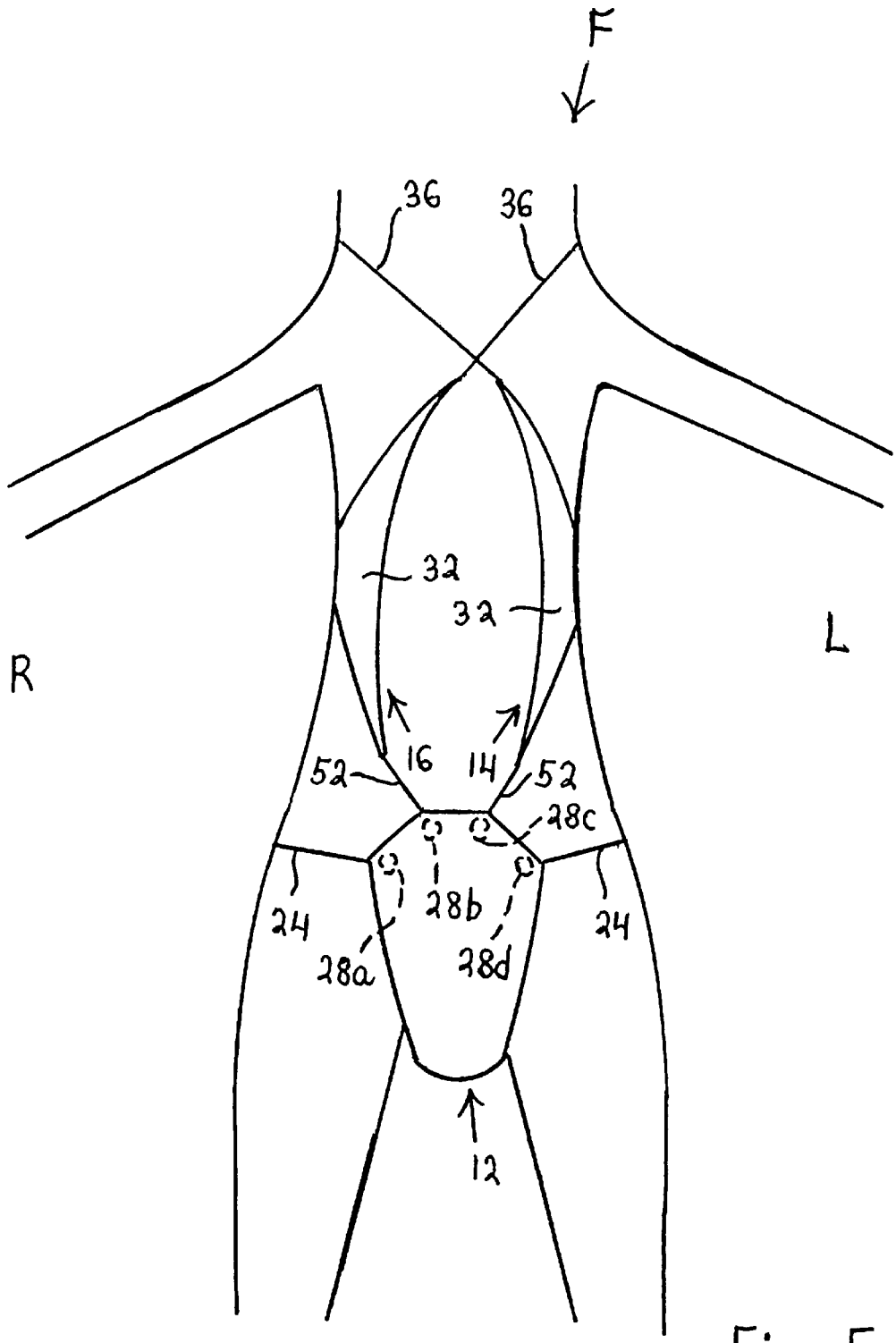
FIG. 5 is similar to FIG. 4 but shows a further look of the apparel.

Considering FIG. 5, the straps 52,54 have been returned to the positions of FIG. 2. However, the female F has inserted the extension 56 between the neck strap section 36,38 of the bikini top 14 and the neck strap section 36,40 of the bikini top 16. To this end, the female F connected the female buckle portion 68 of the extension 56 to the male buckle portion 38 of the neck strap section 36,38 and the male buckle portion 70 of the extension 56 to the female buckle portion 40 of the neck strap section 36,40. The extension 56 increases the length of the neck strap 36,38;36,40 so that the female F can cross the neck strap sections 36,38 and 36,40 in front. Thus, the neck strap section 36,38 of the bikini top 14 on the left side L of the female F extends to the right shoulder whereas the neck strap section 36,40 of the bikini top 16 on the right side R of the female F extends to the left shoulder. This is contrary to FIG. 2 where the neck strap section 36,38 on the left side L extends to the left shoulder and the neck strap section 36,40 on the right side R extends to the right shoulder. After the extended neck strap 36,38;36,40;56 has been positioned around the neck, the female F uses the slide 60 of the extension 56 to lengthen or shorten the latter, and hence to lengthen or shorten the entire extended neck strap 36,38;36,40;56, for a comfortable fit.

While the lower portions of the cups 32 are no longer drawn to the center of the torso, the upper portions are now drawn to this area to some degree. The top of the front portion 20 of the bikini bottom 12 returns to approximately the same configuration as in FIG. 2.

Figure 4:
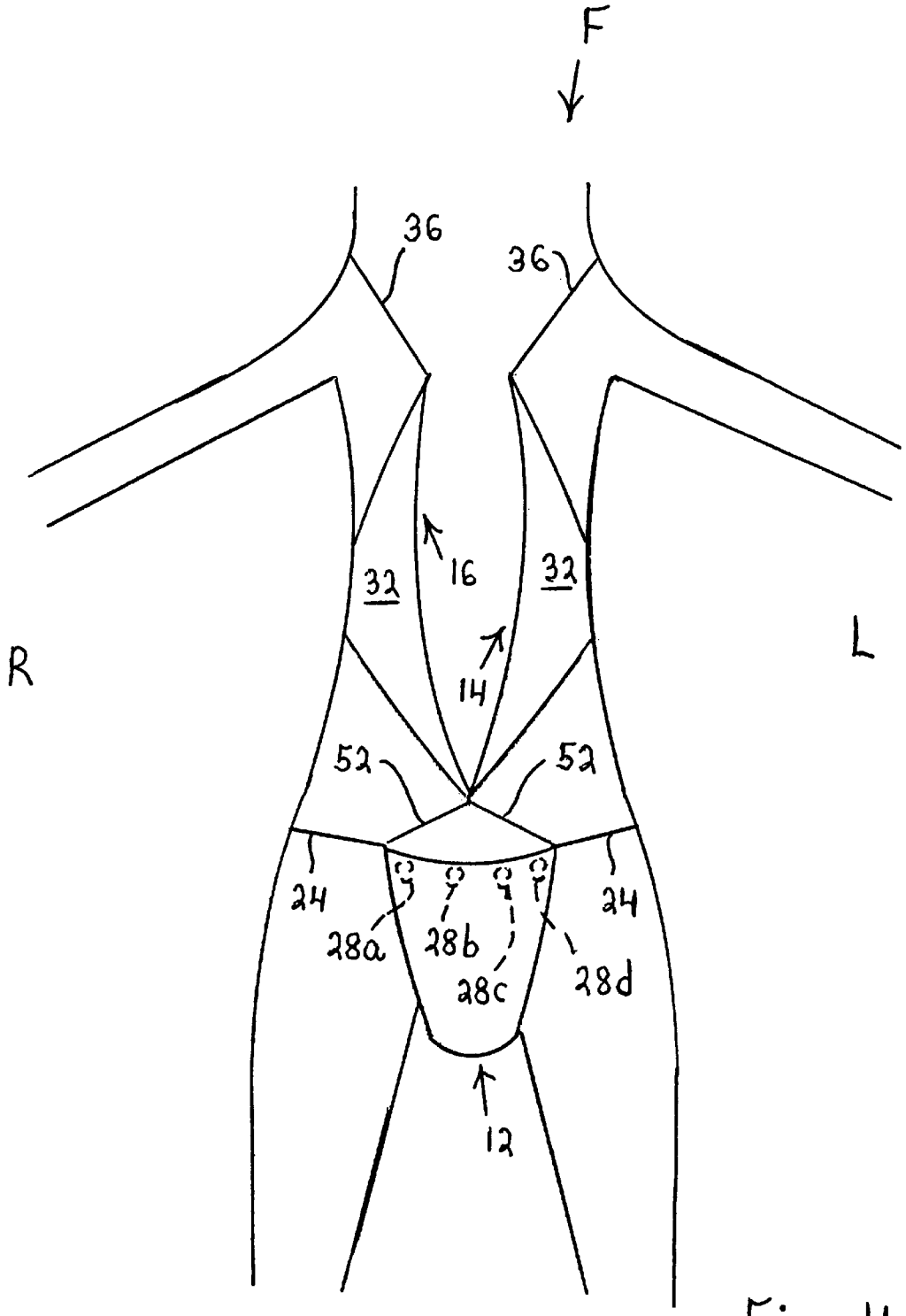
FIG. 4 is similar to FIG. 3 but illustrates an additional look of the apparel.
Figure 6:
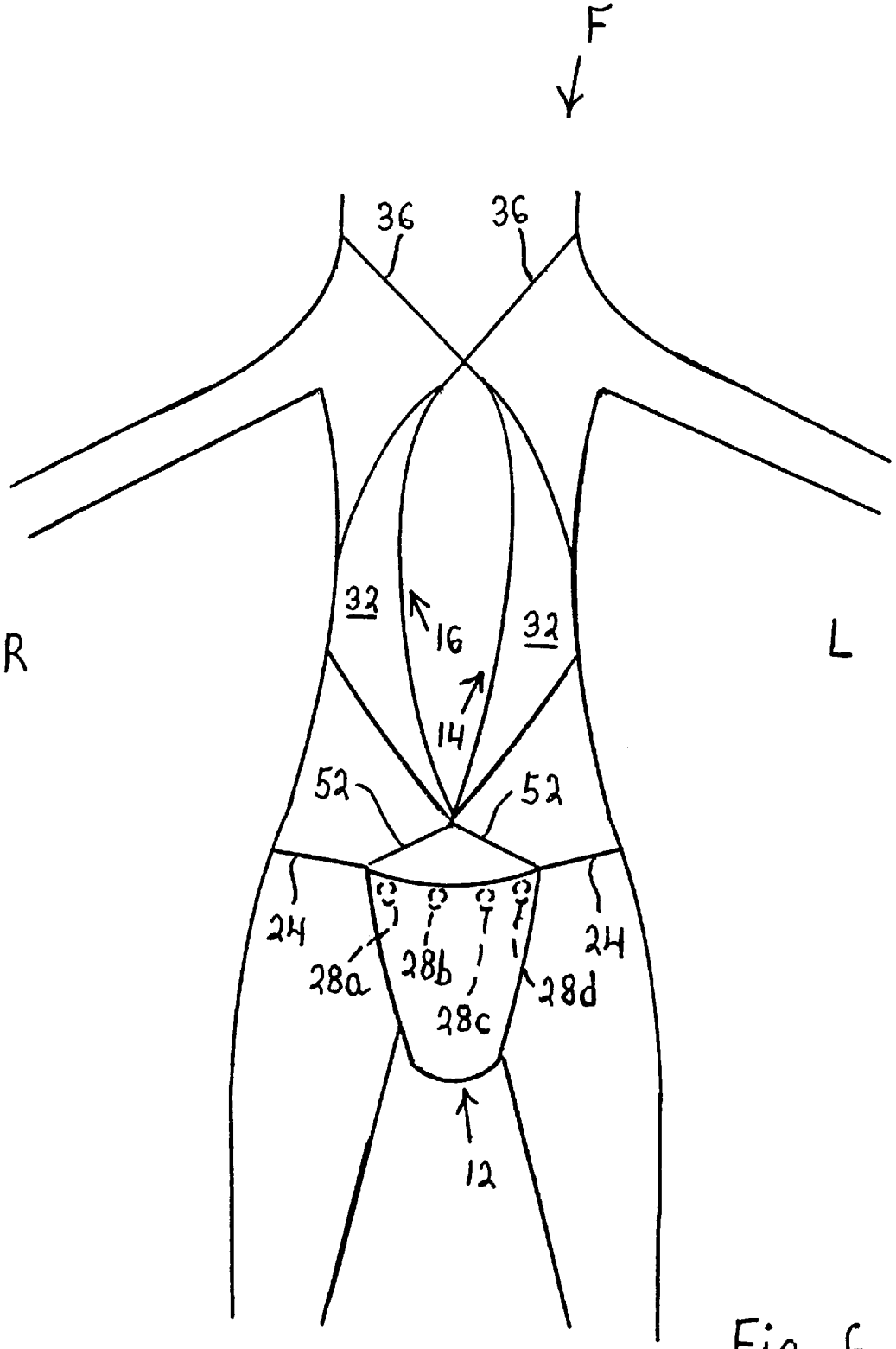
FIG. 6 is similar to FIG. 5 but illustrates one more look of the apparel.

In FIG. 6, the extended neck strap 36,38;36,40;56 is used as in FIG. 5 but with the straps 52,54 now arranged as in FIG. 4. The lower portions of the cups 32 are once more drawn to the center of the torso and the upper portions are drawn in this direction to a lesser degree. The top of the front portion 20 of the bikini bottom 12 again exhibits a slight concavity.

Figure 7:
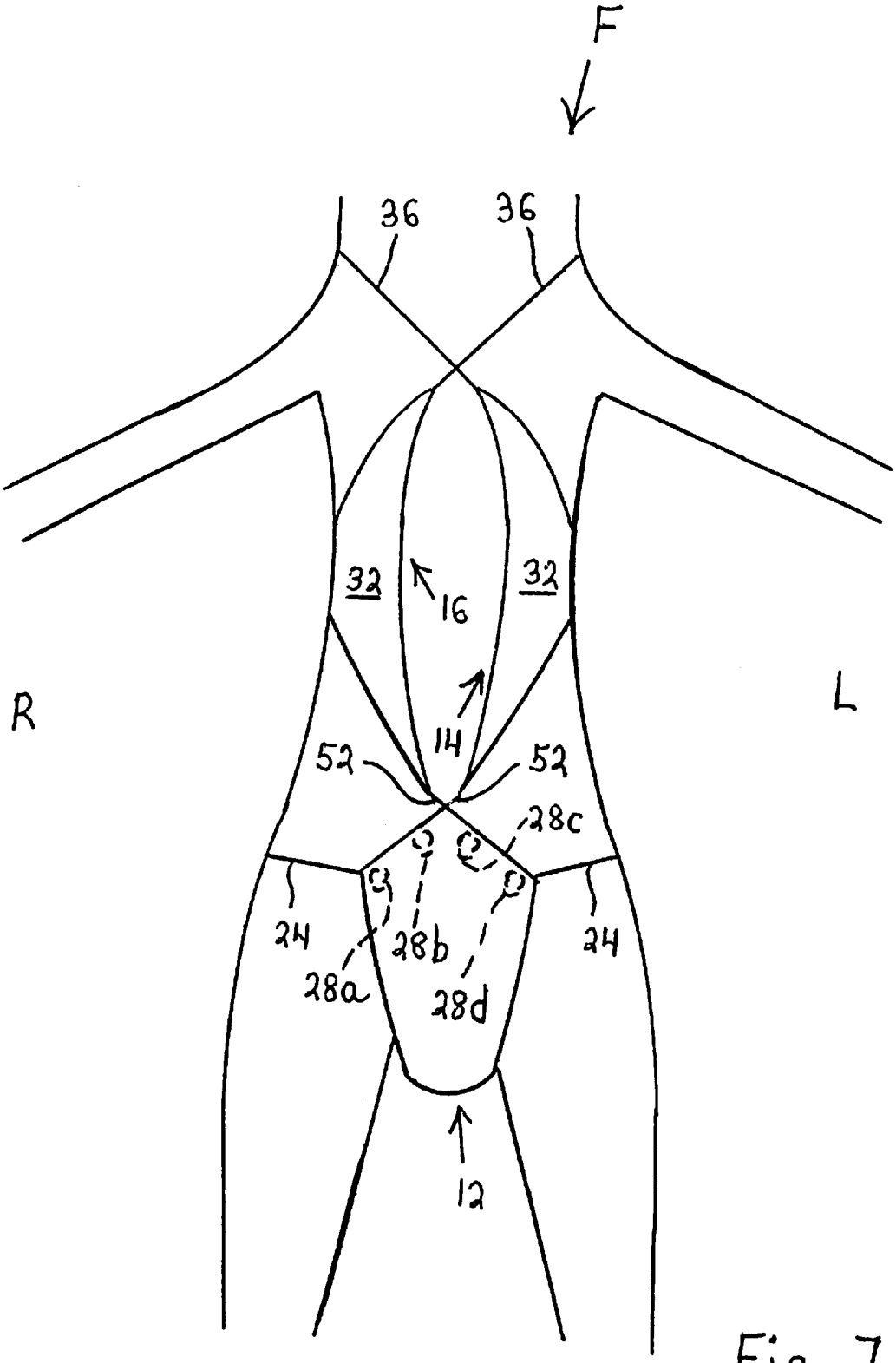
FIG. 7 is similar to FIG. 6 but shows yet another look of the apparel.
Figure 8:
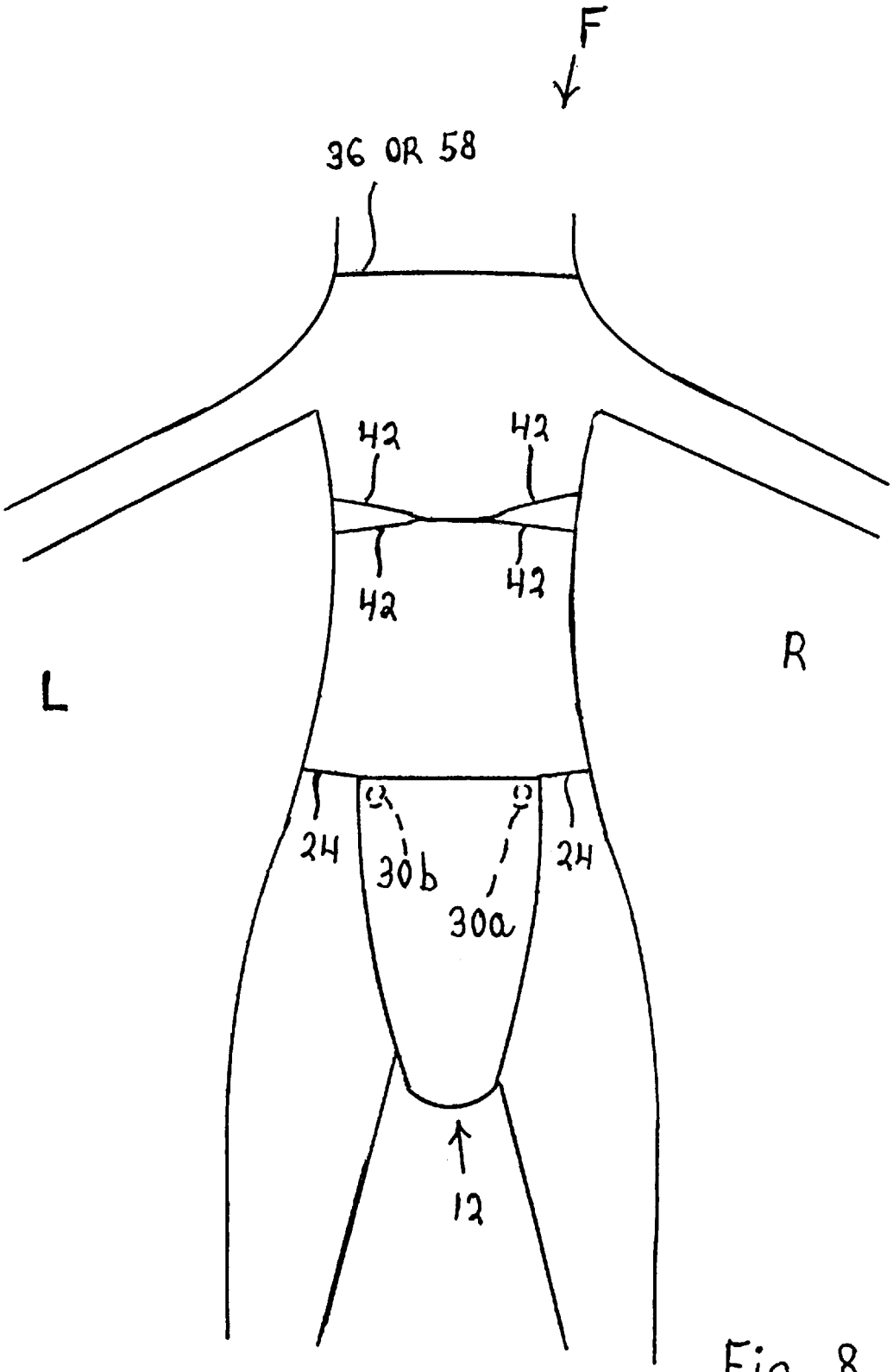
FIG. 8 is a back view of the female of FIGS. 2–7.

With reference to FIG. 7, the extended neck strap 36,38;36,40;56 remains as in FIG. 6. In contrast to FIG. 6, however, the straps 52,54 are in the positions of FIG. 3. As in FIG. 6, the lower portions of the cups 32 are drawn to the center of the torso and the upper portions are drawn towards this region to a lesser degree. The top of the front portion 20 of the bikini bottom 12 is once more peaked.

The back of the female of FIGS. 2–7 is shown in FIG. 8. The straps 42 of the bikini top 14 on the left side of the female F are relatively widely spaced at the left side of the back and converge in a direction towards the middle of the back at a relatively large angle. Similarly, the straps 42 of the bikini top 16 on the right side of the female F are relatively widely spaced at the right side of the back and converge in a direction towards the middle of the back at a relatively large angle. The straps 24 of the bikini bottom 12 have a slight upward inclination.

Figure 9A:
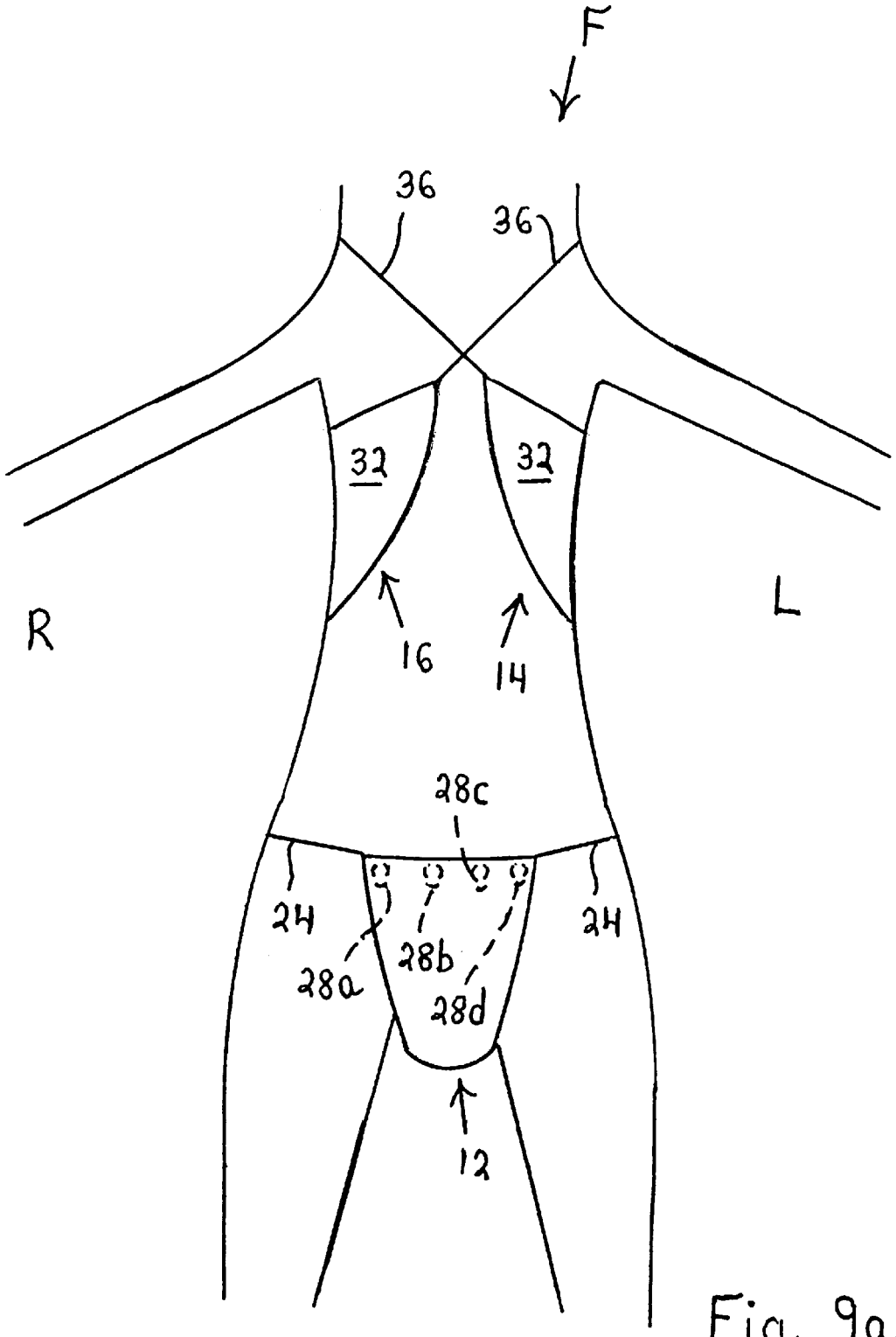
FIGS. 9*a* and 9*b* are, respectively, schematic front and back views of the female wearing the apparel of FIG. 1 with still a further look.
Figure 9B:
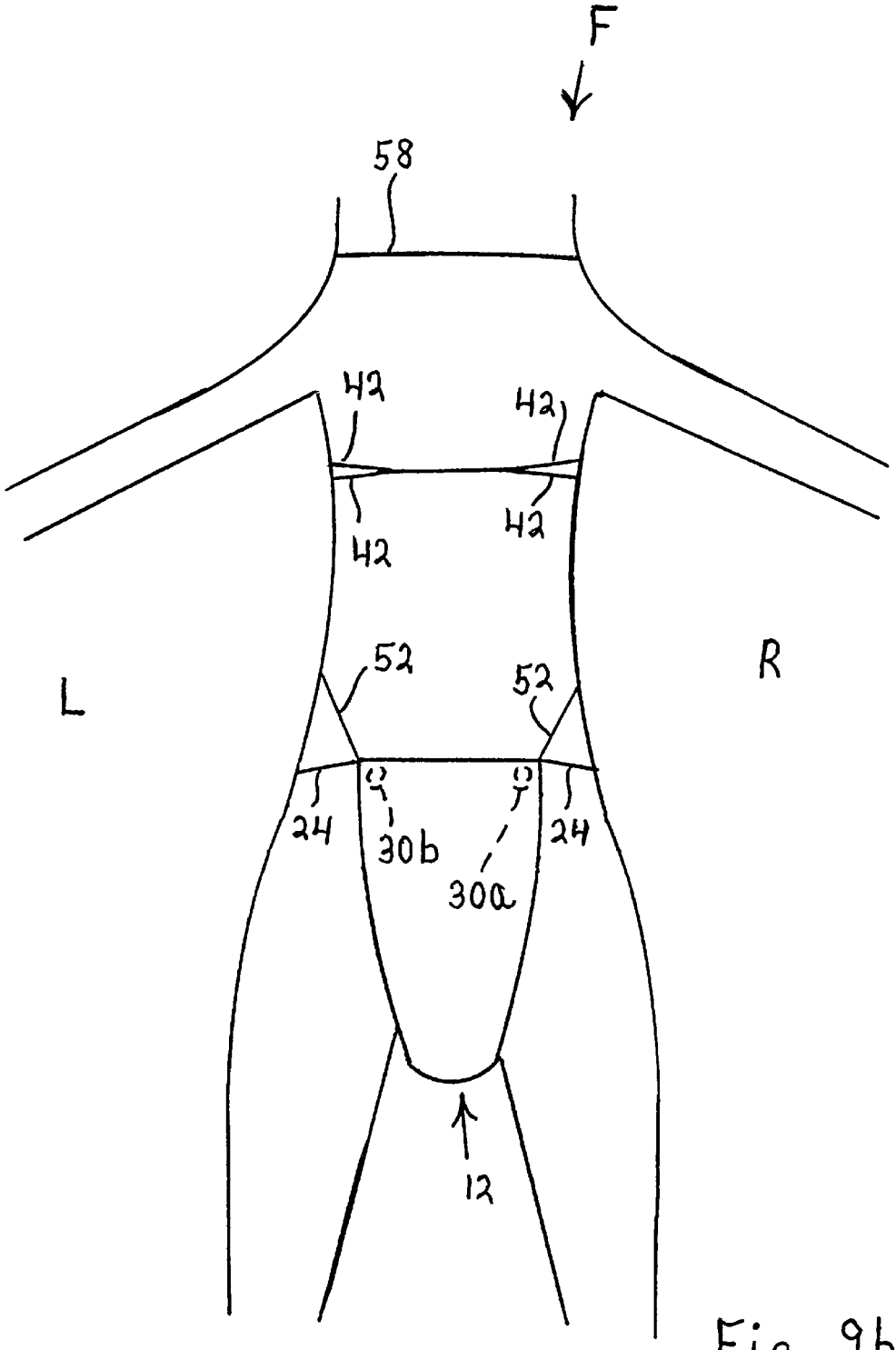

FIGS. 9*a* and 9*b* are a front view and a back view of the female F, respectively. Here, the extended neck strap 36,38;36,40;56 is again as in FIGS. 5–7. On the other hand, as opposed to FIGS. 2–7, the strap 52,54 of the bikini top 14 is connected to the left rear coupling element 30*b* on the bikini bottom 12 and the strap 52,54 of the bikini top 16 is connected to the right rear coupling element 30*a* on the bikini bottom 12. This is illustrated in FIG. 9*b*.

Since the bikini top 14 and the coupling element 30*b* to which the corresponding strap 52,54 is connected are both located on the left side L of the female F, the strap 52,54 and the lower portion of the cup 32 of the bikini top 14 are drawn away from the front of the torso (FIG. 9*a*). Likewise, inasmuch as the bikini top 16 and the coupling element 30*a* to which the corresponding strap 52,54 is connected are both located on the right side R of the female F, the strap 52,54 and the lower portion of the cup 32 of the bikini top 16 are drawn away from the front of the torso (FIG. 9*a*). Consequently, more of the midriff section is exposed than in FIGS. 2–7 where the straps 52,54 and the lower portions of the cups 32 are drawn across the front of the torso.

Returning to FIG. 9*b,* the straps 42 of the bikini top 14 on the left side of the female F are relatively closely spaced at the left side of the back and converge in a direction towards the center of the back at a relatively small angle. Likewise, the straps 42 of the bikini top 16 on the right side of the female F are relatively closely spaced at the right side of the back and converge in a direction towards the center of the back at a relatively small angle. The straps 24 of the bikini bottom 12 have a slight downward inclination.

When the female F no longer wishes for the neck strap sections 36,38 and 36,40 to cross, the female F unbuckles the extension 56. The female F can then uncross the neck strap sections 36,38 and 36,40 and connect the male buckle portion 38 and female buckle portion 40 to one another.

The straps 52,54 on the bikini tops 14,16 and the cooperating coupling elements 28*a*–28*d* and 30*a,*3*b* on the bikini bottom 12 allow the appearance of the bathing suit 10 to be changed simply, rapidly and conveniently. The same holds true for the neck strap extension 56 which makes it possible to increase the number of looks of the bathing suit 10.

The coupling elements 28*a*–28*d,* 30*a,* 30*b* and 54 are preferably in the form of snaps although other types of readily connectible and disconnectible coupling elements, e.g., hook-and-loop fasteners, may be employed. When the coupling elements 28*a*–28*d,* 30*a,* 30*b* and 54 include male and female portions, it is advantageous for the female portions to constitute the coupling elements 28*a*–28*d* and 30*a,*30*b*. This enhances comfort since the coupling elements 28*a*–28*d* and 30*a,*30*b* face the body.

Various modifications are possible within the meaning and range of equivalence of the appended claims.

I claim:

1. Female apparel comprising:

a first cup;

a second cup;

at least one strap for supporting said cups;

a first additional strap designed to extend downward from said first cup when said first cup is being worn;

a second additional strap designed to extend downward from said second cup when said second cup is being worn, said additional straps being relatively movable between a position in which said additional straps cross and a position in which said additional straps are uncrossed;

a covering for the crotch; and a plurality of first coupling elements on said covering, at least one of said additional straps including a second coupling element releasably connectible to each of said first coupling elements;

wherein said one strap includes a first section connected to said first cup and a second section connected to said second cup, said one strap further including first means for releasably connecting said first and second sections to one another; and further comprising an extension insertable between said first and second sections, said extension including second means for releasably connecting said extension to said first means.

2. The apparel of claim 3, wherein said covering has a first portion which is designed to be in front when said covering is being worn and a second portion which is designed to be in back when said covering is being worn, each of said portions being provided with a plurality of said first coupling elements.

3. The apparel of claim 1, wherein said extension has a variable effective length.

4. Female apparel comprising:

a first cup;

a second cup;

at least one strap for supporting said cups;

a first additional strap designed to extend downward from said first cup when said first cup is being worn;

a second additional strap designed to extend downward from said second cup when said second cup is being worn, said additional straps being relatively movable between a position in which said additional straps cross and a position in which said additional straps are uncrossed;

a covering for the crotch; and a plurality of first coupling elements on said covering at least one of said additional straps including a second coupling element releasably connectible to each of said first coupling elements;

wherein said one strap includes a first section connected to said first cup and a second section connected to said second cup, said one strap further including means for releasably connecting said first and second sections to one another, and said connecting means including a first connecting element on said first section and a second connecting element on said second section, said first cup, said first section, said first connecting element and said first additional strap at least partly constituting a discrete first article of clothing, and said second cup, said second section, said second connecting element and said second additional strap at least partly constituting a discrete second article of clothing.

5. The apparel of claim 4, further comprising another strap for supporting said cups, said other strap including another first section connected to said first cup, another second section connected to said second cup, and other means for releasably connecting said other first section and said other second section to one another, said other connecting means comprising another first connecting element on said other first section and another second connecting element on said other second section, said other first section and said other first connecting element constituting part of said first article, and said other second section and said other second connecting element constituting part of said second article.

6. The apparel of claim 5, wherein said one strap is a neck strap and said other strap is a back strap.

7. Female apparel comprising:

a first cup;

a second cup;

at least one strap for supporting said cups, said one strap including a first section connected to said first cup, a second section connected to said second cup, and first means for releasably connecting said first and second sections to one another; and an extension insertable between said first and second sections, said extension including second means for releasably connecting said extension to said first means.

8. The apparel of claim 7, wherein said extension has a variable effective length.

9. A method of altering the appearance of female apparel having a first cup, a second cup, a covering for the crotch, a first strap extending from said first cup to a first location of said covering and a second strap extending from said second cup to a second location of said covering, and another strap for supporting said cups and said other strap having two separable sections, said method comprising the steps of shifting at least part of said first strap so that said first strap extends from said first cup to a location of said covering different from said first location; and inserting an extension between said sections.

10. The method of claim 9, further comprising the step of shifting at least part of said second strap so that said second strap extends from said second cup to a location of said covering different from said second location.

11. The method of claim 9, wherein said straps are uncrossed prior to the shifting step and the shifting step comprises crossing said straps.

12. The method of claim 9, wherein said straps cross prior to the shifting step and the shifting step comprises uncrossing said straps.

13. The method of claim 9, further comprising the step of varying the effective length of said extension.

14. The method of claim 9, further comprising the steps of arranging said other strap so as to be uncrossed, and repositioning said other strap so that portions of said other strap cross.

15. The method of claim 9, further comprising the steps of arranging said other strap so that portions of said other strap cross, and repositioning said other strap so that said other strap is uncrossed.

16. A method of altering the appearance of female apparel having a first cup, a second cup, and at least one strap for supporting said cups, said one strap having two separable sections, and said method comprising the step of inserting an extension between said sections.

17. The method of claim 16, further comprising the step of varying the effective length of said extension.

* * * * *